US007300165B2

(12) United States Patent
Garcia

(10) Patent No.: US 7,300,165 B2
(45) Date of Patent: Nov. 27, 2007

(54) GUARDRAIL REFLECTOR/DELINEATOR AND MOUNTING DEVICE THEREFOR

(75) Inventor: Guadalupe C. Garcia, Tijuana (MX)

(73) Assignee: Worldwide Safety, Inc., Sacramento, CA (US)

( * ) Notice: Subject to any disclaimer, the term of this patent is extended or adjusted under 35 U.S.C. 154(b) by 0 days.

(21) Appl. No.: 11/125,887

(22) Filed: May 9, 2005

(65) Prior Publication Data

US 2006/0082881 A1 Apr. 20, 2006

Related U.S. Application Data

(60) Provisional application No. 60/570,229, filed on May 11, 2004, provisional application No. 60/572,148, filed on May 17, 2004.

(51) Int. Cl.
*G02B 5/12* (2006.01)

(52) U.S. Cl. ..... 359/528

(58) Field of Classification Search ..... 359/528, 359/529, 530, 531, 532, 533, 534
See application file for complete search history.

(56) References Cited

U.S. PATENT DOCUMENTS

| | | | | |
|---|---|---|---|---|
| 2,047,436 | A * | 7/1936 | Shepherd | 256/13.1 |
| 3,954,324 | A | 5/1976 | Arnott et al. | 350/109 |
| 4,000,882 | A | 1/1977 | Penton | 256/13.1 |
| 4,191,449 | A * | 3/1980 | Hirata | 359/552 |
| 4,534,673 | A | 8/1985 | May | 404/14 |
| 5,975,706 | A | 11/1999 | Nakayama | 359/530 |
| 6,558,010 | B2 * | 5/2003 | Takahashi | 359/552 |
| 6,656,571 | B2 | 12/2003 | Benson et al. | 428/156 |
| 2004/0146677 | A1 | 7/2004 | Boyd | 428/36.91 |
| 2004/0146693 | A1 | 7/2004 | Boyd | 428/143 |

OTHER PUBLICATIONS

Rail Bright, Retro-Vision by US Reflector [online], [retrieved on Apr. 29, 2004] Retrieved from the Internet: <URL: http://www.ncnwest.com/nercp/railbrt/> US Reflector, "Roadside Delineation".

* cited by examiner

*Primary Examiner*—Euncha P. Cherry
(74) *Attorney, Agent, or Firm*—Lumen Intellectual Property Services, Inc.

(57) ABSTRACT

The invention provides new reflective markers, reflectors, and delineators with a variety of mounting apparatuses for attaching the same onto standard guardrails in an efficient and effortless manner, without affecting the safety feature, display utility, and visibility of the marker/reflectors/delineators mounted thereon. The present invention also provides a new guardrail reflector/delineator that is particularly useful in situations, locations, and/or places with limited or no lighting, for example, cloudy days, foggy areas, dark places, streets with no lights at night, etc.

24 Claims, 8 Drawing Sheets

GUARDRAIL REFLECTOR/DELINEATOR AND MOUNTING DEVICE THEREFOR

CROSS-REFERENCE TO RELATED APPLICATIONS

The present application claims priority from provisional patent applications No. 60/570,229, filed May 11, 2004, and No. 60/572,148, filed May 17, 2004, both of which are incorporated herein by reference.

FIELD OF THE INVENTION

The present invention relates generally to guardrail reflectors and delineators and more particularly to a new guardrail delineation system with mounting brackets for fast and secure installation thereof.

DESCRIPTION OF THE BACKGROUND ART

Guardrail plays an important role in saving the lives of people involved in accidents. It is commonly installed on interstates, highways, secondary roads, curved roads, road sides, bridges, corners, or even parking lots to shield vehicles from natural and man-made roadside hazards, such as cliffs, trees, rivers, ditches, utility poles, railroad tracks, signs, etc. For safety, strength, durability, and cost effectiveness, standard guardrail is made of 10-12 gauge, zinc plated galvanized steel.

Galvanized steel gives guardrail a dull, monotonous general appearance. Thus, most people often do not notice or pay attention to its existence until an accident occurs and it saves lives or prevents dreadful things from happening.

A variety of rail markers, delineators, reflectors, and the likes are available today to enhance guardrail's visibility and warn or otherwise inform drivers/motorists of danger. They are becoming increasingly desirable or even essential wherever guardrail, sometimes termed "guard rail", is utilized.

Most of the existing guardrail reflectors/delineators are fabricated with prismatic and/or reflective materials. Some of these products require drilling holes through the guardrail to be permanently mounted thereon. Some are mounted through the center rail support bolts that are part of standard guardrails. A product named "Rail Bright" by US Reflector of Worcester, Mass., can be temporarily mounted on the guardrail without screws, glue, or tape. However, if permanent fixation is required, Rail Bright must be installed with double-sided pressure sensitive tape and/or aluminum rivets. Rail Bright is made of pre-formed (molded) plastic coated with a reflective film by 3M™.

Clearly, there is a continuing need in the art for a simple yet effective reflective/delineation system that can be securely mounted onto guardrails in a fast, efficient, and cost effective way without glues, adhesives, tapes, or any chemical bonding agents. The present invention addresses this need.

SUMMARY OF THE INVENTION

An object of the present invention to provide a new guardrail reflector/delineator with a variety of mounting apparatuses that can be characterized as fasteners, clips, brackets, hooks, and so on.

The mounting apparatuses disclosed herein are durable, long lasting, weather/temperature resistant, virtually maintenance free, easy to install, and relatively cost effective. Most importantly, they ensure that the reflectors/delineators are firmly attached to guardrails in an efficient and effortless manner, without affecting the safety feature, display utility, and visibility of the marker/reflectors/delineators mounted thereon.

Another object of the present invention is to provide a new guardrail reflector/delineator that is particularly useful in situations, locations, and/or places with limited or no lighting, for example, cloudy days, foggy areas, dark places, streets with no lights at night, etc.

Still further objects and advantages of the present invention will become apparent to one of ordinary skill in the art upon reading and understanding the detailed description of the preferred embodiments and the drawings illustrating the preferred embodiments disclosed herein.

DETAILED DESCRIPTION OF THE PREFERRED EMBODIMENTS

Although the following detailed description contains many specifics for the purposes of illustration, anyone of ordinary skill in the art will readily appreciate that many variations and alterations to the following exemplary details are within the scope of the invention. Accordingly, the following preferred embodiments of the invention are set forth without any loss of generality to, and without imposing limitations upon, the claimed invention.

Figure 1:
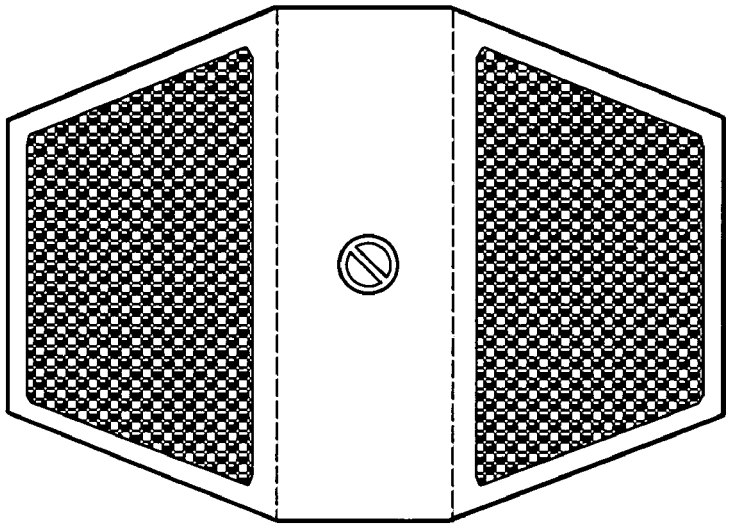
FIG. 1 is a front view of an exemplary embodiment of a reflector/delineator according the present invention.
Figure 1A:
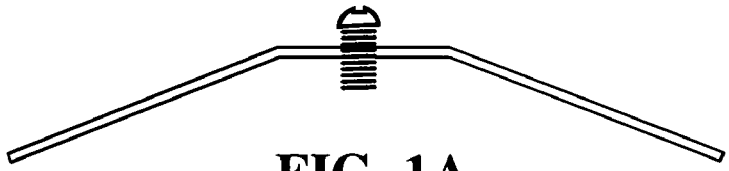
FIG. 1A is a top view of the embodiment shown in FIG. 1.
Figure 1B:
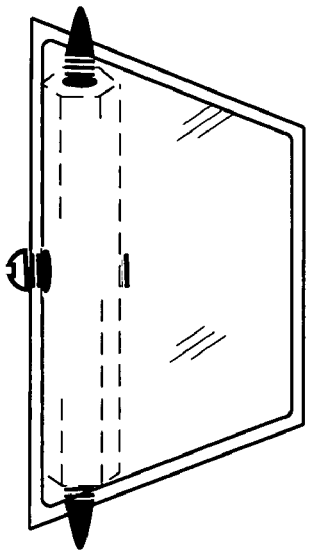
FIG. 1B is a right side view of the reflector/delineator and screw of FIG. 1A.

FIG. 1 is a front view of an exemplary embodiment of a reflector/delineator according to an aspect of the invention. The reflector/delineator has three main panels or surface areas—left, center, and right. The reflector/delineator is an apparatus easily attachable to a standard guardrail with, for example, one screw, through a hole in the center panel. FIG. 1A is a top view of the embodiment shown in FIG. 1. FIG.

1B is a right side view of the reflector/delineator and screw of FIG. 1A assembled with a mounting apparatus represented by dashed lines. To install, an end user mounts the mounting apparatus onto a guardrail (not shown) and secures the reflector/delineator onto the mounting apparatus with the screw.

Figure 2:
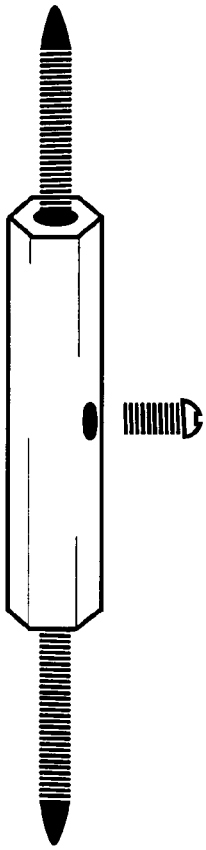
FIGS. 2-7A illustrate various exemplary mounting apparatuses suitable for attaching the reflector/delineator of FIG. 1 to a standard guardrail.

FIGS. 2-7A illustrate various exemplary mounting apparatuses suitable for attaching the reflector/delineator of FIG. 1 to a standard guardrail. FIG. 2 illustrates a single piece mounting apparatus with one mounting screw and a built-in corresponding hole/recessed area/cavity through which the reflector/delineator/marker of FIG. 1 can be directly attached. The body of the mounting apparatus is hollow inside appropriate for receiving two adjustable ends that enable the mounting apparatus to mount securely onto a guardrail (not shown).

Figure 3:
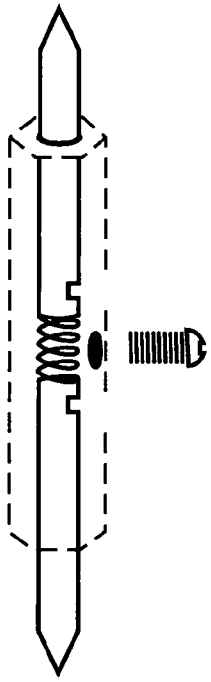

FIG. 3 illustrates a quick-release mounting apparatus. The apparatus has a body and two height adjusting means, for instance, pillars, sticks, or rods, each with at least one pointy end. Each height adjusting means has a hole, an indentation, a notch, or a recessed area located near one end thereof that is connected to a spring or coil positioned inside of the body. The body has two holes or small windows through which the spring or coil is adjustable, i.e., depressed or relaxed, by clipping or releasing notches. As such, the apparatus can be quickly installed on or released from a guardrail (not shown). The body has a screw/mounting hole appropriate for mounting the reflector/delineator of FIG. 1. If so desired, one can first create two small dimples or dints, by a power drill, a nail and a hammer, or other suitable means, on the guardrail at corresponding locations where the height-adjusting means or screws are to be installed.

Figure 4:
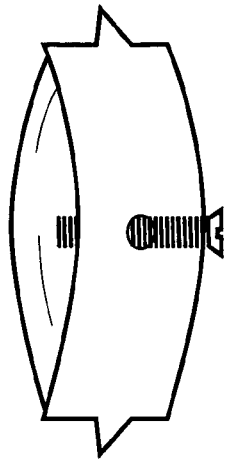

FIG. 4 illustrates another mounting apparatus with a built-in adjustable portion. The mounting apparatus has a mounting plate with two pointy ends and one hole. The mounting apparatus further includes a length/height adjusting means, e.g., a flexible back panel, permanently attached to the mounting plate towards the two pointy ends thereof. The entire length/height of the mounting apparatus is adjustable by turning a screw, by hand or with a hand tool such as a screwdriver, to increase or reduce the strain placed on either or both the mounting plate and the back panel. The mounting apparatus is attachable to a guardrail (not shown) via the two pointy ends. The single screw facilitates both the adjustment of the length/height of the body and the mounting of a reflector/delineator as shown in FIG. 1. Again, an end user can optionally make two small dimples or dints, by a power drill, a nail and a hammer, or other suitable means, on the guardrail at corresponding locations where the height-adjusting means or screws are to be installed.

Figure 5:
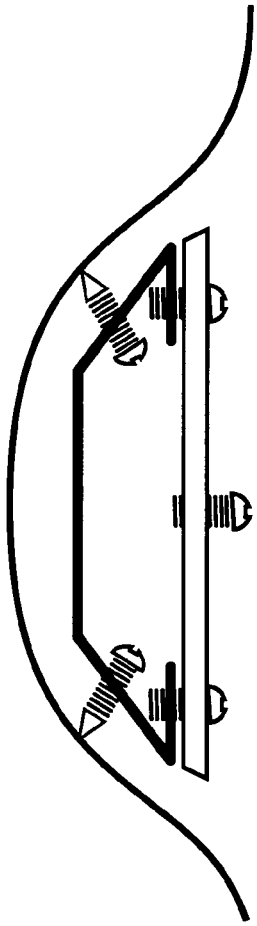

FIG. 5 illustrates a mounting apparatus having a clip or bracket that is curved, shaped, or bent to fit the center portion or a profile of a standard guardrail. The clip or bracket is attachable to the guardrail via two screws or nails. The mounting apparatus further includes a mounting part, plate, or panel that has three screw holes, two for securely attaching the mounting plate to the clip or bracket and one for mounting a desired reflector/delineator as shown in FIG. 1 via a screw. The clip part and the mounting part can be made of the same or different durable, weather resistant materials such as aluminum, stainless steel, molded plastic, rubber, alloy, recycled materials, etc.

Figure 6:
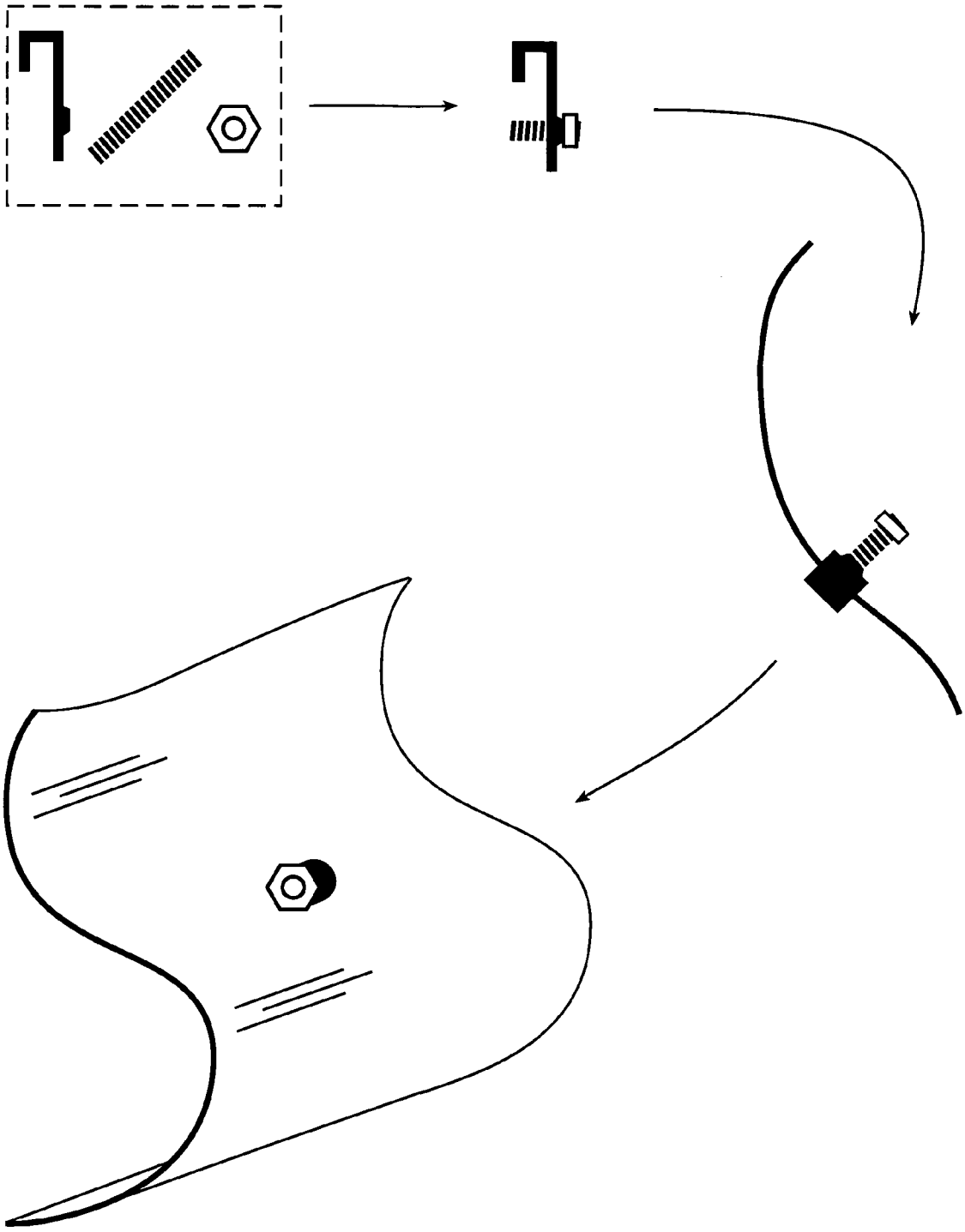

FIG. 6 illustrates a self-tightening mounting apparatus. The mounting apparatus has a mounting assembly consisting of a small bracket or clip, a threaded pin or bolt, and a nut. The mounting apparatus can be securely mounted onto a guardrail via the mounting assembly. A desired marker, reflector, or delineator can then be mounted onto the mounting apparatus via the nut. The bracket is shaped in a way to catch the guardrail via the standard guardrail support bolt, thereby stopping the screw from turning when screwing the nut on. No additional screws are necessary.

Figure 7:
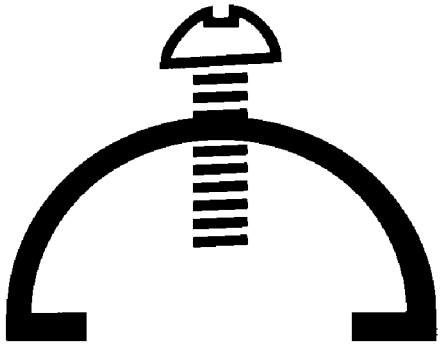
Figure 7A:
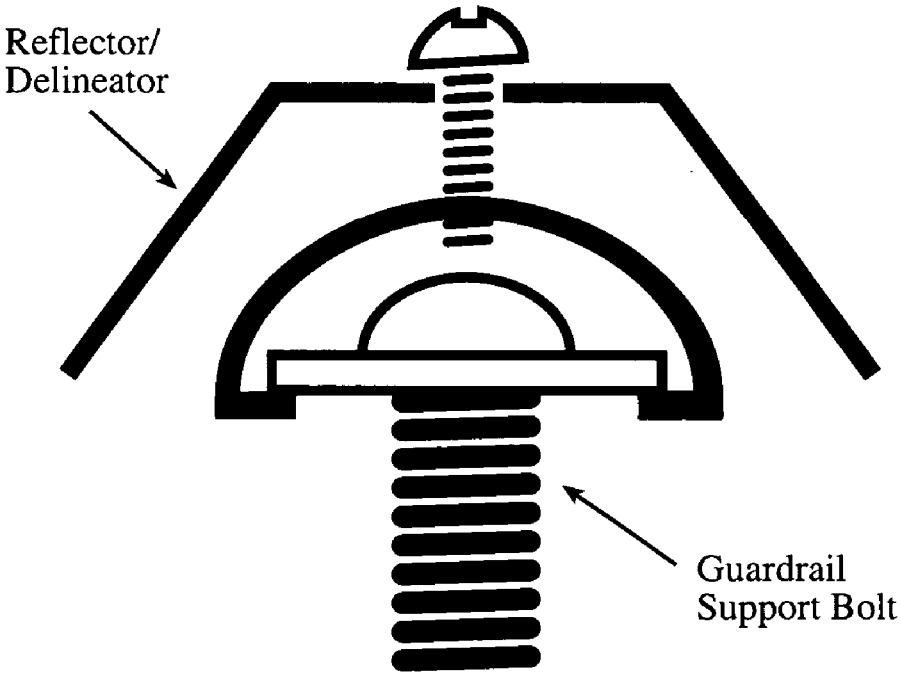

FIG. 7 shows another self-tightening mounting apparatus. FIG. 7A exemplifies how the mounting apparatus of FIG. 7 functions to securely attach both a reflector/delineator, such as one shown in FIG. 1, and the mounting apparatus itself onto a guardrail support bolt.

One skilled in the art will appreciate that the self-tightening mounting assembly is not limited to what is shown here. The bracket or clip as well as of the threaded pin or bolt may be varied in styles, designs, and shapes, for example, an "L" shape, so long as it can be securely attached to a guardrail support bolt.

One skilled in the art will also appreciate that the reflector/delineator disclosed herein can have various designs and be made of various materials, reflective as well as non-reflective. For example, according to needs and/or applications, reflective material can be laminated over, applied to, or otherwise covers one, two, or all of the panels or main surface areas of the reflector/delineator in same or different colors and/or configurations.

Figure 8:
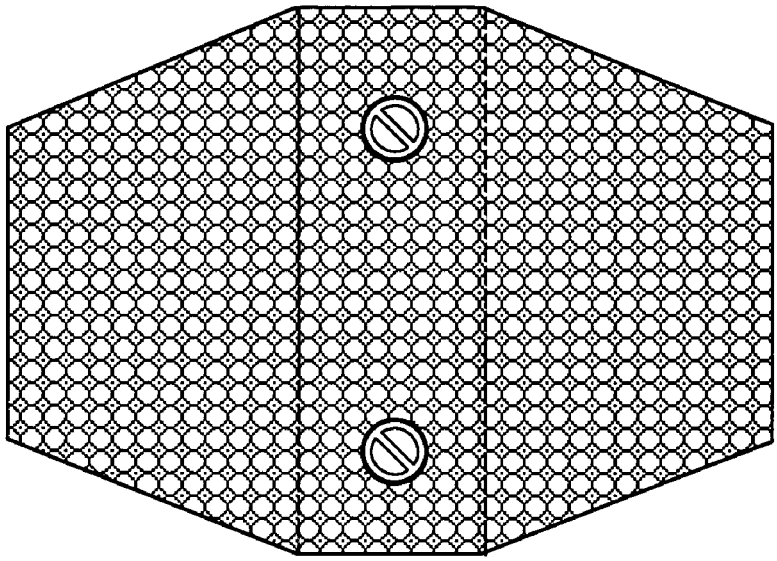
FIGS. 8-10 illustrate various exemplary embodiments of the reflector/delineator according the present invention in which the three panels of the reflector/delineator are in same or different combinations of colors and/or shades.
Figure 9:
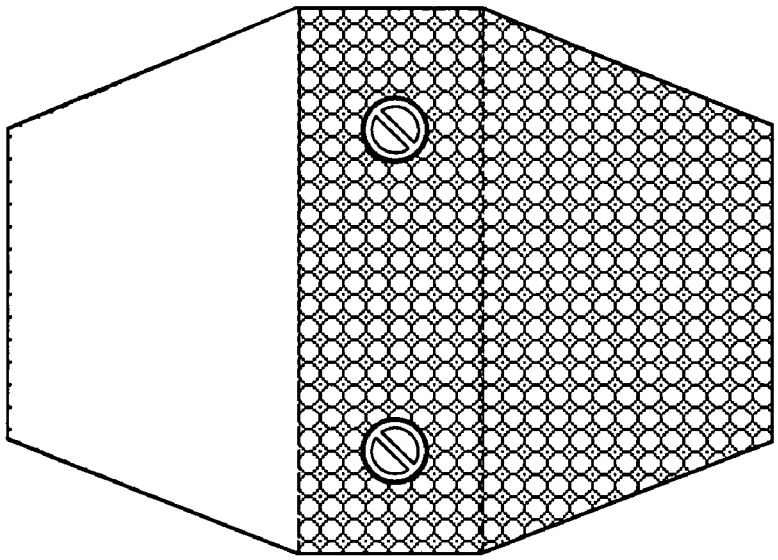
Figure 10:
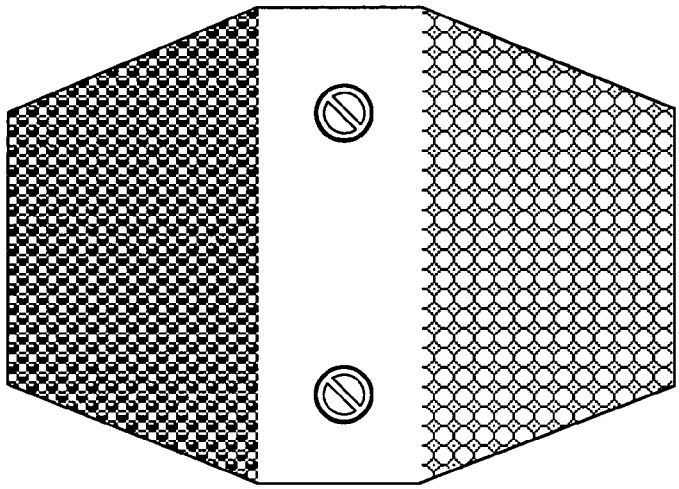

In the example shown in FIG. 1, the two side panels have the same reflective color, pattern, or shade that is different from that of the center panel. FIG. 8 shows that the entire surface is of the same reflective material and color/shade, i.e., all three panels are made of a single sheet of reflective material having the same reflective color, pattern, or shade. FIG. 9 shows that the center and one of the side panels have the same reflective color or shade that is different from that of the other side panel. FIG. 10 shows three panels (left, center, and right) in different reflective colors or shades.

Figure 11:
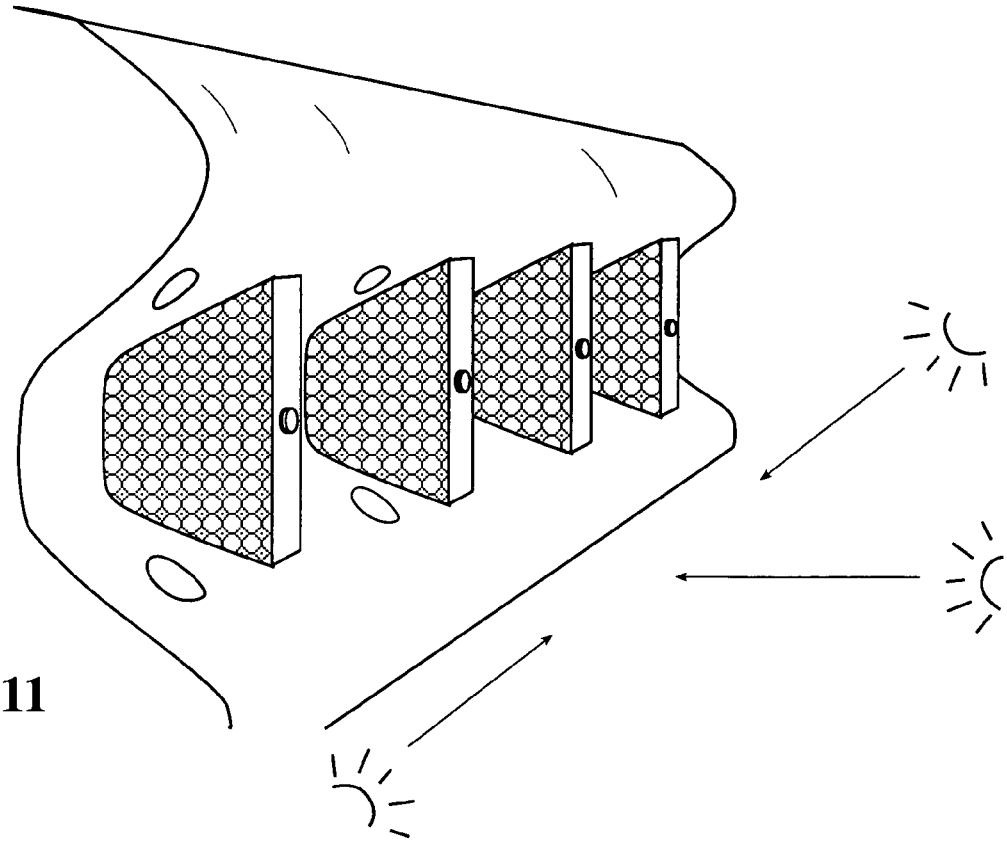
FIG. 11 illustrates an embodiment of the present invention in which a plurality of reflective markers are installed onto a standard guardrail to provide directional warning and/or guidance.

FIG. 11 shows a plurality of reflective markers having at least two different colors or shades installed onto a standard guardrail. Once installed, the reflectors/delineators would appear to be in at least two different colors from at least two different directions or angles. For example, they would appear to be in a first bright color from a first direction/angle that is orthogonal or substantially orthogonal to a first reflective panel, in a second reflective color from a second direction/angle that is orthogonal or substantially orthogonal to a second reflective panel, and in a third reflective color from a third direction/angle that is orthogonal or substantially orthogonal to a third reflective panel, as shown in FIG. 11.

Figure 12:
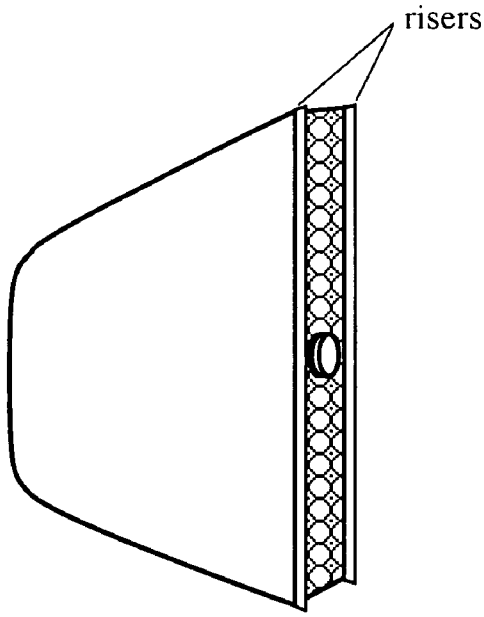
FIG. 12 illustrates an embodiment of the present invention in which the reflector/delineator has raised panels, edges, or risers running lengthwise along one or both sides of the center panel thereof.

In some embodiments, the reflector/delineator of the present invention has raised panels, edges, or risers running lengthwise along one or both sides of the center panel thereof. As illustrated in FIG. 12, these risers function as shutters to block or prevent the center panel from reflecting light coming from certain directions/angles. That is, the risers prevent the center panel from reflecting light that may interfere with the different color light(s) reflected by its neighboring panel(s). For example, only those having a frontal view of the reflector/delineator will see the bright color or shade reflected by the center panel.

Figure 13:
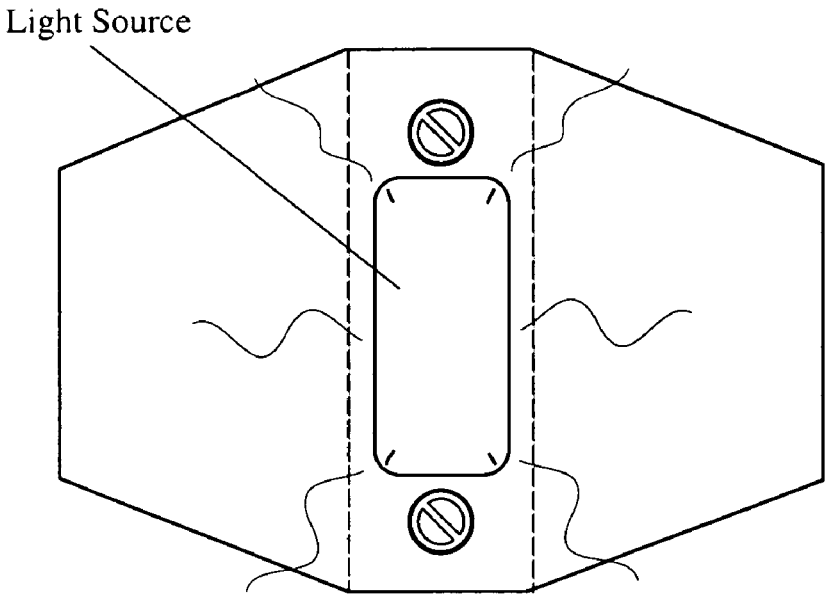
FIG. 13 is a front view of an exemplary embodiment of a reflector/delineator integrated with a light source, according to an aspect of the invention.

FIG. 13 is a front view of an exemplary embodiment of a reflector/delineator integrated with a light source, according to an aspect of the invention. The reflector/delineator has three main panels or surface areas—left, center, and right. Similar to the embodiment shown in FIG. 1, the reflector/delineator is attachable to standard guardrails and is contoured, shaped, or otherwise configured in such a way to fit snuggly the center portion or a profile of a standard guardrail.

The light source is powered by solar energy. In this example, the solar energy is supplied from a remote solar panel (not shown). One skilled in the art will appreciate that the location of the solar panel is not limiting. The solar panel does not have to be directly attached to the reflector/delineator. So long as it is electrically coupled thereto, it can be positioned at a location that is near or proximate (very close in space) to the reflector/delineator. In some embodiments, a single solar panel is configured to supply power to a plurality of reflectors/delineators having integrated lights. These lights can be constant or intermittent, depending upon the needs and applications.

Figure 14:
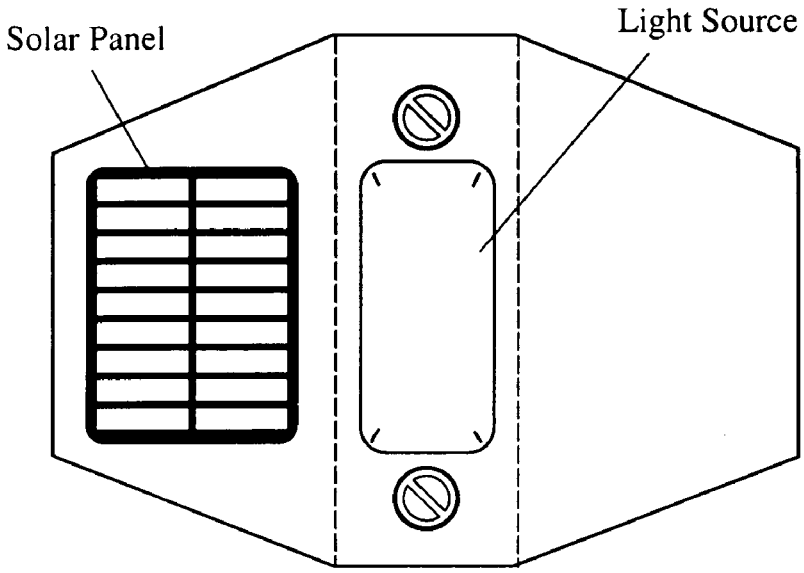
FIG. 14 is a front view of an exemplary embodiment of a reflector/delineator integrated with a light source and a solar panel for powering the light source, according to the invention.
Figure 14A:
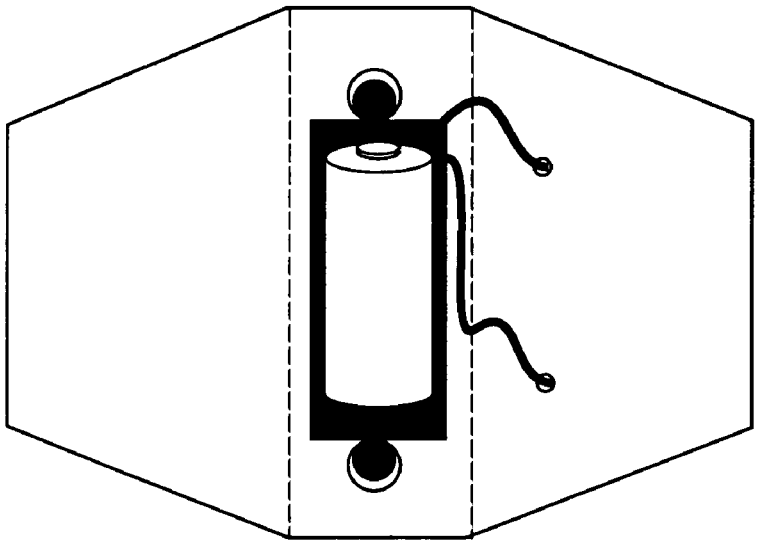
FIG. 14A is a back view of the exemplary reflector/delineator of FIG. 14 showing an integrated solar power assembly.

In some embodiments, the light source is powered by an integrated solar panel and a solar power assembly securely attached to or directly mounted on the reflector/delineator, as shown in FIGS. 14-14A. The solar power assembly may comprise one or more batteries for retaining the electricity obtained from the corresponding solar cell(s) or panel(s) that are mounted on one of the front panels.

The solar panel provides power to the lighting device or light source mounted on one of the front panels, preferably the center panel. One skilled in the art will appreciate that the present invention is not limited to any particular arrangement or number of the light sources, the solar panel (cell), and the solar power assembly shown in the drawings. Various arrangements, types, and different combinations of light source and power supply are possible. For example, various solar panels are commercially available and can be readily implemented with the present invention. Similarly, the light source can also vary in many different ways. In some embodiments, the light source is a single or multiple ultra bright light emitting diodes (LEDs). LEDs are known to have very low power consumption and long lifespan, making them an ideal light source candidate for implementing the present invention. Other suitable off-the-shelf or customized light source is possible and can be readily implemented with the present invention.

Although the present invention and its advantages have been described in detail, it should be understood that the present invention is not limited to or defined by what is shown or discussed herein. The drawings, description and discussion herein show examples of the invention and provide examples of using the invention. One skilled in the art will realize that implementations of the present invention could be made without departing from the principles, spirit or legal scope of the present invention. Accordingly, the scope of the present invention should be determined by the following claims and their legal equivalents.

What is claimed is:

1. An apparatus, comprising:

a removable guardrail mounting device for securing said apparatus to a standard guardrail, said removable guardrail mounting device having (i) an adjustable portion with mounting ends at either end of said adjustable potion, said mounting ends to securely mount said guardrail mounting device onto said standard guardrail, and (ii) at least one receiving recess for a center panel;

said center panel having at least one hole for securing said center panel to said removable guardrail mounting device, said at least one hole of said center panel aligned with said at least one receiving recess of said removable guardrail mounting device, said center panel secured to said removable guardrail mounting device by a bolt through each of said aligned hole and receiving recess pairs;

a first panel connected to said center panel, said first panel having a first reflective surface; and a second panel connected to said center panel, said second panel having a second reflective surface; wherein said center panel, said first panel, and said second panel are contoured, shaped, or configured to fit a profile of said standard guardrail.

2. The apparatus of claim 1, wherein said first reflective surface and said second reflective surface are of same or different material, reflectivity, color, pattern, shade, or a combination thereof.

3. The apparatus of claim 1, wherein said center panel, said first panel, and said second panel are made of a single sheet of material.

4. The apparatus of claim 1, wherein said center panel, said first panel, and said second panel are laminated with materials having same or different reflectivity, color, pattern, shade, or a combination thereof.

5. The apparatus of claim 1, further comprising:

raised panels, edges, or risers running lengthwise along one or both sides of said center panel for preventing light reflected by said center panel from interfering with light reflected by said first panel, said second panel, or both.

6. The apparatus of claim 1, further comprising:

a light source integrated onto said center panel, said first panel, or said second panel.

7. The apparatus of claim 6, further comprising:

a power supply for supplying power to said light source.

8. The apparatus of claim 7, wherein said power supply comprises a solar panel.

9. The apparatus of claim 8, wherein said power supply comprises a solar power assembly attached to back of said center panel, said first panel, or said second panel; and wherein said solar power assembly comprises at least one battery for retaining electricity obtained from said solar panel.

10. The apparatus of claim 8, wherein said solar panel is mounted on front of said center panel, said first panel, or said second panel.

11. The apparatus of claim 8, wherein said solar panel is electrically coupled to said light source from a remote location.

12. The apparatus of claim 6, wherein said light source comprises a single or multiple ultra bright light emitting diodes.

13. A delineator comprising:

a plurality of reflectors, each reflector comprising:

a removable guardrail mounting device for securing said reflector to a standard guardrail, said removable guardrail mounting device having (i) an adjustable portion with mounting ends at either end of said adjustable potion to securely mount said guardrail mounting device onto said standard guardrail, and (ii) at least one receiving recess for a center panel;

said center panel having at least one hole for securing said center panel to said removable guardrail mounting device, said at least one hole of said center panel aligned with said at least one receiving recess of said removable guardrail mounting device, said center panel secured to said removable guardrail mounting device by a bolt through each of said aligned hole and receiving recess pairs;

a first panel connected to said center panel, said first panel having a first reflective surface; and a second panel connected to said center panel, said second panel having a second reflective surface; wherein said center panel, said first panel, and said second panel are contoured, shaped, or configured to fit a profile of said standard guardrail.

14. The delineator of claim 13, wherein said first reflective surface and said second reflective surface are of same or different material, reflectivity, color, pattern, shade, or a combination thereof.

15. The delineator of claim 14, wherein said center panel has a surface that is same or different from said first reflective surface in material, reflectivity, color, pattern, shade, or a combination thereof.

16. The delineator of claim 13, further comprising:

raised panels, edges, or risers running lengthwise along one or both sides of said center panel for preventing light reflected by said center panel from interfering with light reflected by said first panel, said second panel, or both.

17. The delineator of claim 13, further comprising:

a light source integrated onto said center panel, said first panel, or said second panel.

18. The delineator of claim 13, further comprising:

a power supply for supplying power to said light source; wherein said power supply comprises a solar panel electrically coupled to said light source; and wherein said solar panel is mounted on said reflector or positioned at a location proximate to said delineator.

19. The delineator of claim 18, wherein said power supply comprises a solar power assembly attached to back of said center panel, said first panel, or said second panel; and wherein said solar power assembly comprises at least one battery for retaining electricity obtained from said solar panel.

20. The delineator of claim 17, wherein said light source comprises a single or multiple ultra bright light emitting diodes.

21. The apparatus of claim 1, wherein said first reflective surface and said second reflective surface are of different material, reflectivity, color, pattern, shade, or a combination thereof.

22. The apparatus of claim 1, wherein said center panel, said first panel, and said second panel are laminated with materials having the same or different reflectivity, color, pattern, shade, or a combination thereof.

23. The delineator of claim 13, wherein said first reflective surface and said second reflective surface are of the same or different material, reflectivity, color, pattern, shade, or a combination thereof.

24. The delineator of claim 14, wherein said center panel has a surface that is different from said first reflective surface in material, reflectivity, color, pattern, shade, or a combination thereof.

* * * * *